US007958966B2

(12) United States Patent
Smith

(10) Patent No.: US 7,958,966 B2
(45) Date of Patent: Jun. 14, 2011

(54) EXHAUST STACK FAIRING

(75) Inventor: Jeffrey P. Smith, Prosper, TX (US)

(73) Assignee: PACCAR Inc, Bellevue, WA (US)

( * ) Notice: Subject to any disclaimer, the term of this patent is extended or adjusted under 35 U.S.C. 154(b) by 52 days.

(21) Appl. No.: 12/415,451

(22) Filed: Mar. 31, 2009

(65) Prior Publication Data

US 2010/0242462 A1 Sep. 30, 2010

(51) Int. Cl.
*F01N 1/08* (2006.01)

(52) U.S. Cl. ..... 181/264; 181/212; 181/247; 181/282; 181/261; 181/262; D12/194

(58) Field of Classification Search ..... 181/212, 181/247, 248, 251, 252, 264, 282; D12/194
See application file for complete search history.

(56) References Cited

U.S. PATENT DOCUMENTS

| | | | | |
|---|---|---|---|---|
| 1,408,868 | A | 3/1922 | Dutcher | |
| 2,010,945 | A | 8/1935 | Carleton | |
| 2,017,207 | A | 10/1935 | Hathorn | |
| 2,126,785 | A | 8/1938 | Laddon | |
| 2,177,887 | A | 10/1939 | Huet | |
| 2,289,400 | A | 7/1942 | Woods | |
| 2,397,957 | A | 4/1946 | Freeman | |
| 2,458,130 | A | 1/1949 | Andreau | |
| 2,659,293 | A * | 11/1953 | Valensi | 454/2 |
| 3,865,311 | A * | 2/1975 | Paxhia et al. | 239/568 |
| 4,078,605 | A | 3/1978 | Jones | |
| 4,171,674 | A | 10/1979 | Hale | |
| 4,474,129 | A | 10/1984 | Watkins | |
| 4,665,691 | A * | 5/1987 | Eller | 60/316 |
| 4,970,859 | A * | 11/1990 | Yates et al. | 60/324 |
| D357,665 | S * | 4/1995 | Creyts | D12/194 |
| 5,722,235 | A | 3/1998 | Cumins | |
| 6,802,387 | B1 * | 10/2004 | Kreger et al. | 181/228 |
| 6,915,611 | B2 | 7/2005 | Reiman | |
| 7,434,656 | B2 * | 10/2008 | Yasuda et al. | 181/227 |
| 7,703,573 | B2 * | 4/2010 | Feight et al. | 181/239 |
| 2003/0168279 | A1 * | 9/2003 | Shaw et al. | 181/227 |
| 2009/0014235 | A1 * | 1/2009 | Troxler | 181/228 |

* cited by examiner

*Primary Examiner* — Forrest M Phillips
(74) *Attorney, Agent, or Firm* — Christensen O'Connor Johnson Kindness PLLC

(57) ABSTRACT

A fairing is configured for use with the exhaust stack of a heavy-duty vehicle. The exhaust stack has an exhaust pipe with an intake end for receiving exhaust gases from an internal combustion engine and a discharge end for discharging the exhaust gases. The fairing includes a streamlined exterior surface and a cavity for receiving the discharge end of the exhaust pipe. An aperture extends through a rear portion of the exterior surface so that exhaust gases discharged from the discharge end of the exhaust pipe pass through the cavity and out of the aperture. The fairing further includes a coupler to couple the fairing to the exhaust pipe.

16 Claims, 10 Drawing Sheets

EXHAUST STACK FAIRING

BACKGROUND

Most heavy-duty vehicles include a powertrain driven by an internal combustion (IC) engine. During operation, these engines produce high temperature exhaust gases, as well as particulate matter, such as soot. For such vehicles, particularly those having diesel engines, the products of engine combustion are typically discharged through vertical exhaust stacks to an area above the vehicle cab. Discharging the gases in this manner reduces the amount of exhaust gases and particulate matter that are blown onto the portion of the vehicle located to the rear of the exhaust stack. This, in turn, reduces the potential for heat damage to the vehicle, as well as the unsightly accumulation of soot on the vehicle. Discharging the exhaust gases at an elevated location also decreases the risk that a person standing near a vehicle with a running engine will be directly exposed high temperature exhaust.

Vertical exhaust stacks are typically positioned along the side of the vehicle cab, to the rear of the vehicle door. In order to simplify the design and to avoid the problems inherent with ducting hot exhaust gases through an interior portion of the vehicle, the vertical exhaust stacks generally extend vertically along an outside portion of the cab, from the bottom of the cab to a discharge point positioned above the cab. Although routing the exhaust stack along an exterior portion of the vehicle cab simplifies the exhaust system configuration, exposing the exhaust stack and, therefore, the exhaust pipe to the air stream creates drag, thereby reducing the aerodynamic efficiency of the vehicle. Thus, it is desirable to provide an exhaust stack that creates less drag than currently known exhaust stacks.

SUMMARY

In a first embodiment, a fairing for the exhaust stack of a heavy-duty vehicle is disclosed. The exhaust stack has an exhaust pipe with an intake end for receiving exhaust gases from an internal combustion engine and a discharge end for discharging the exhaust gases. The fairing has a streamlined exterior surface and a cavity for receiving the discharge end of the exhaust pipe. An aperture extends through a rear portion of the exterior surface so that exhaust gases discharged from the discharge end of the exhaust pipe pass through the cavity and out of the aperture. The fairing further includes a coupler to couple the fairing to the exhaust pipe.

In a second embodiment, an aerodynamic exhaust stack for a heavy-duty vehicle having an internal combustion engine is disclosed. The exhaust stack includes an exhaust pipe and a fairing. A first end of the exhaust pipe is in fluid connection with the vehicle engine to receive exhaust gases. Exhaust gases received from the engine are discharged from the second end of the exhaust pipe to an area outside of the vehicle. At least a portion of the exhaust pipe is exposed to an air stream when the vehicle moves in a forward direction. The fairing has a streamlined exterior surface and an internal cavity for receiving the discharge end of the exhaust pipe. The fairing further includes an aperture extending through a rear portion of the exterior surface so that exhaust gases are discharged from the exhaust pipe to an area outside of the fairing. A coupler couples the fairing to the discharge end of the exhaust pipe.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Embodiments of the disclosed subject matter will now be described with reference to the drawings where like numerals correspond to like elements. The described embodiments are directed to systems and methods for reducing the aerodynamic drag on vehicles. More specifically, the disclosed embodiments are directed to systems and methods that reduce aerodynamic drag on heavy-duty vehicles, such as tractor-trailer combinations, having vertical exhaust stacks located on an exterior portion of the vehicle. Although embodiments are described with reference to vertical exhaust stacks common to heavy-duty vehicles, one skilled in the relevant art will appreciate that the systems and methods can be applied to other types of vehicles and to other structure mounted to an exterior portion of the vehicle. Accordingly, the following descriptions and illustrations herein should be considered illustrative in nature, and not limiting the scope of the disclosed subject matter as claimed.

Figure 1:
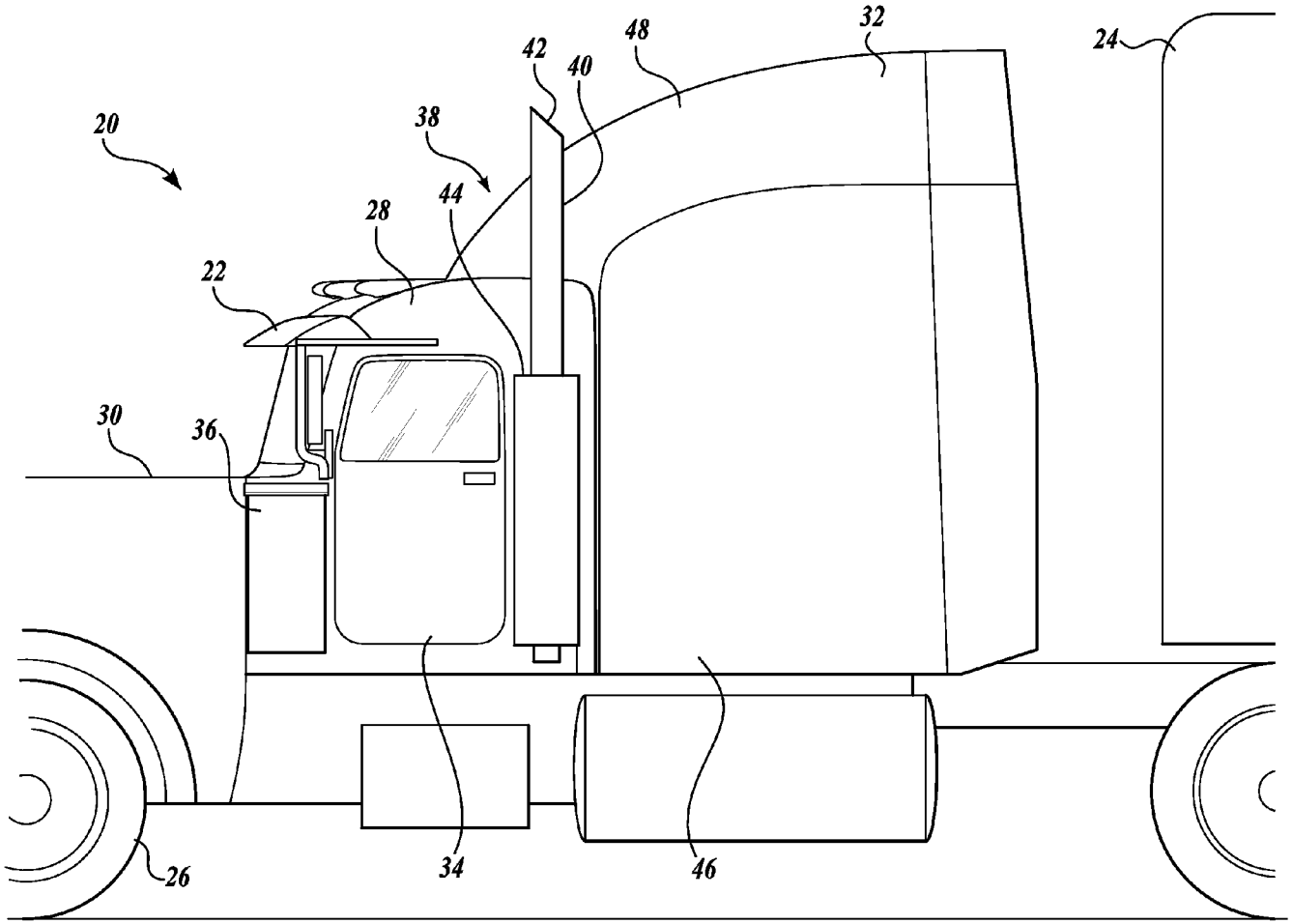
Fig. 1. (PRIOR ART)
FIG. 1 shows a side view of a heavy-duty vehicle having with a known exhaust stack configuration.
Figure 2:
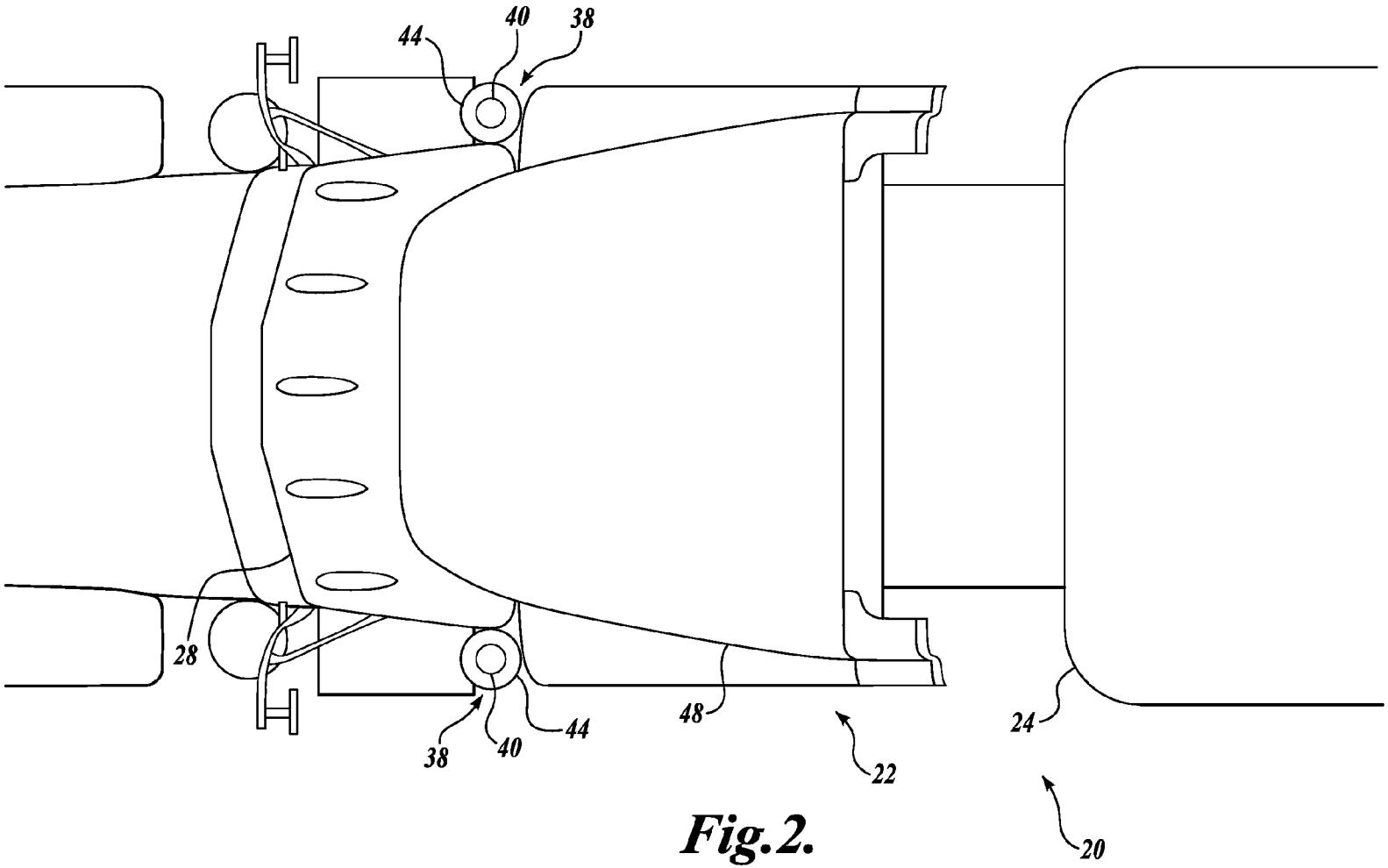
Fig.2. (PRIOR ART)
FIG. 2 shows a top view of the heavy-duty vehicle shown in FIG. 1.

Turning now to FIGS. 1 and 2, there is shown a portion of a known tractor-trailer combination 20 comprising a heavy-duty vehicle 22 (a tractor) that is functionally connected to a trailer 24. The tractor 22 comprises a chassis supported by wheels 26 connected thereto via known suspension assemblies. A conventional cab assembly 28 is supportably mounted on the chassis. The cab assembly 28 includes a front end 30, which generally houses an internal combustion engine (not shown) to propel the vehicle, and a rear end 32. A door 34 is positioned on the side of the cab assembly 28 to allow ingress to and egress from the cab. The illustrated tractor further includes a substantially cylindrical air cleaner 36 positioned proximal to the side of the cab assembly 28, forward of the door 34.

A vertical exhaust stack 38 is positioned proximal to the side of the cab assembly 28 and extends upwardly adjacent to the rear of the door 34. The exhaust stack 38 includes an exhaust pipe 40 having an intake end (not shown) in fluid connection with the engine to receive exhaust gases and other products of combustion from the engine. A discharge end 42 of the exhaust pipe 40 is located above the cab to discharge the exhaust gases above and to the side of the cab 28. A heat shield 44 is positioned around a lower portion of the exhaust pipe 40.

Locating the discharge end of the exhaust pipe 40 above the cab 28 serves several purposes. First, discharging the exhaust gases above the cab reduces noise within the cab 28. More importantly, discharging the exhaust gases above the cab 28 also reduces the chances that a person standing near the vehicle 22 will be exposed to the hot exhaust gases being discharged from the exhaust pipe 40.

As shown, the cab assembly 28 may include an optional sleeper box 46 and various roof fairings 48, if desired, but these features are not required to appreciate the benefits of the disclosed subject matter. Collectively, however, these structures are referred to herein as the cab assembly or cab 28. It will be understood that a myriad of possible combinations and cab shapes can comprise the cab assembly 28. Further, as is known in the art, the vehicle 22 may include fairings or cowls (not shown) mounted to the front end 30 of the cab assembly 28 for improving the aerodynamics of the tractor 22, if desired. While the vehicle 22 is shown as a conventional type tractor, aspects of the disclosed subject matter work equally well with cab over engine (COE) type tractor configurations.

Figure 3:
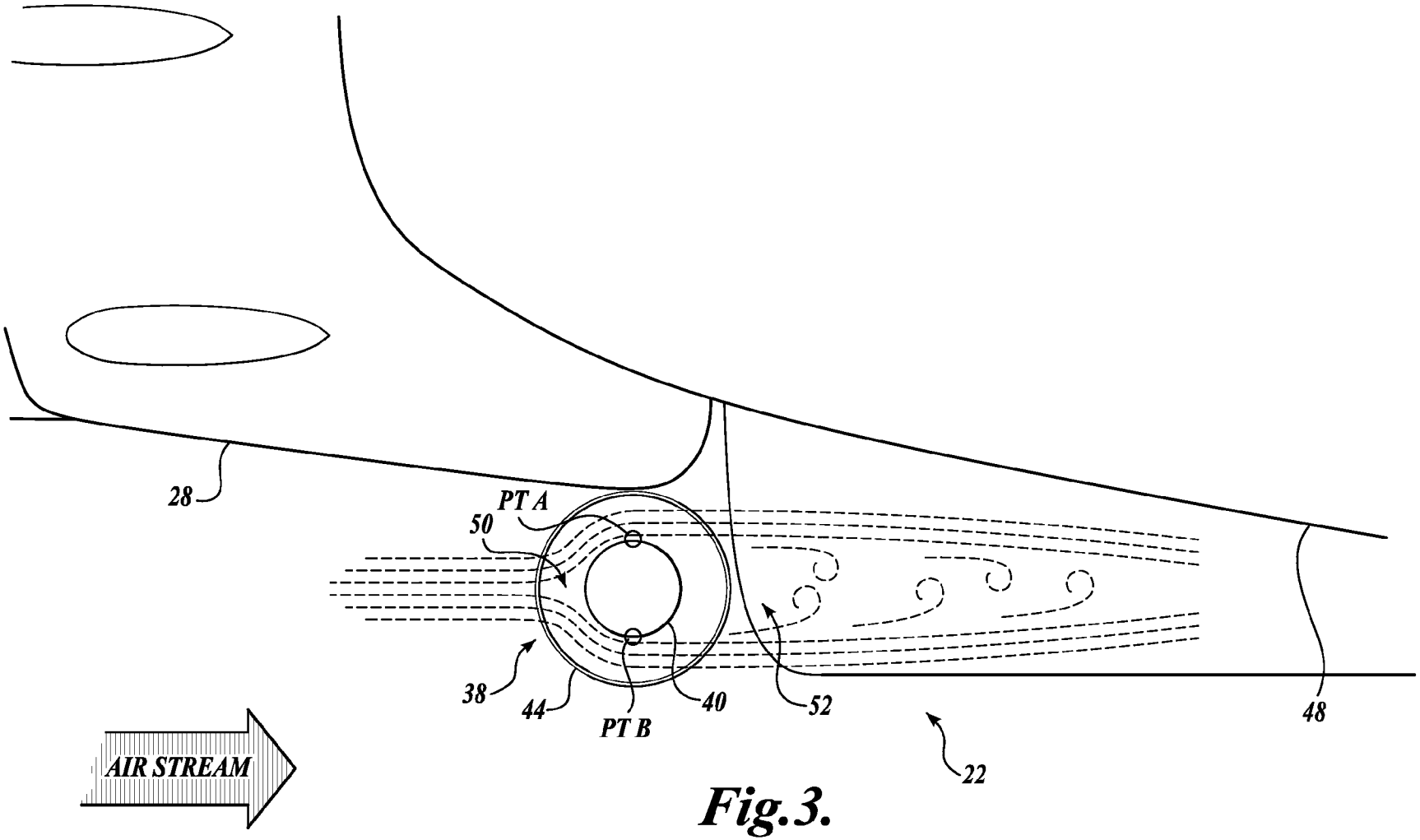
Fig.3. (PRIOR ART)
FIG. 3 shows a pattern of air flow around the exhaust pipe shown in FIG. 2 when the heavy-duty vehicle moves in a forward direction.

Movement of the vehicle 22 in a forward direction results in rearward moving air stream relative to the vehicle. As shown in FIG. 3, wherein the idealized flow of the air stream around the discharge end of the exhaust pipe 40 is represented by dashed lines, the air stream around the exhaust pipe 40 is substantially laminar when the vehicle 22 is moving in a forward direction at a normal highway speed of approximately 60 miles per hour. Under such conditions, the generally laminar air stream impinges the leading edge of the exhaust pipe 40, creating a high-pressure area 50. The air stream flows around the inboard and outboard sides of the exhaust pipe 40, following the contour of the exhaust pipe until it separates from the exhaust pipe at separation points A and B. Separation points A and B are located approximately halfway between the leading edge and the trailing edge of the exhaust pipe, along the inboard and outboard sides, respectively. After separating from the side of the exhaust pipe 40, the laminar air flows in a rearward direction, leaving a low pressure, turbulent area 52 at the trailing edge of the exhaust pipe.

The pressure in the turbulent flow area 52 to the rear of the exhaust pipe 40 is less than that in the high pressure area 50 at the leading edge of the exhaust pipe. As a result, a pressure differential exists that creates a pressure drag on the exhaust pipe 40. In addition, the laminar air flow to the rear of the exhaust pipe 40 impinges a portion of the cab 28, further increasing the overall vehicle drag.

Figure 4:
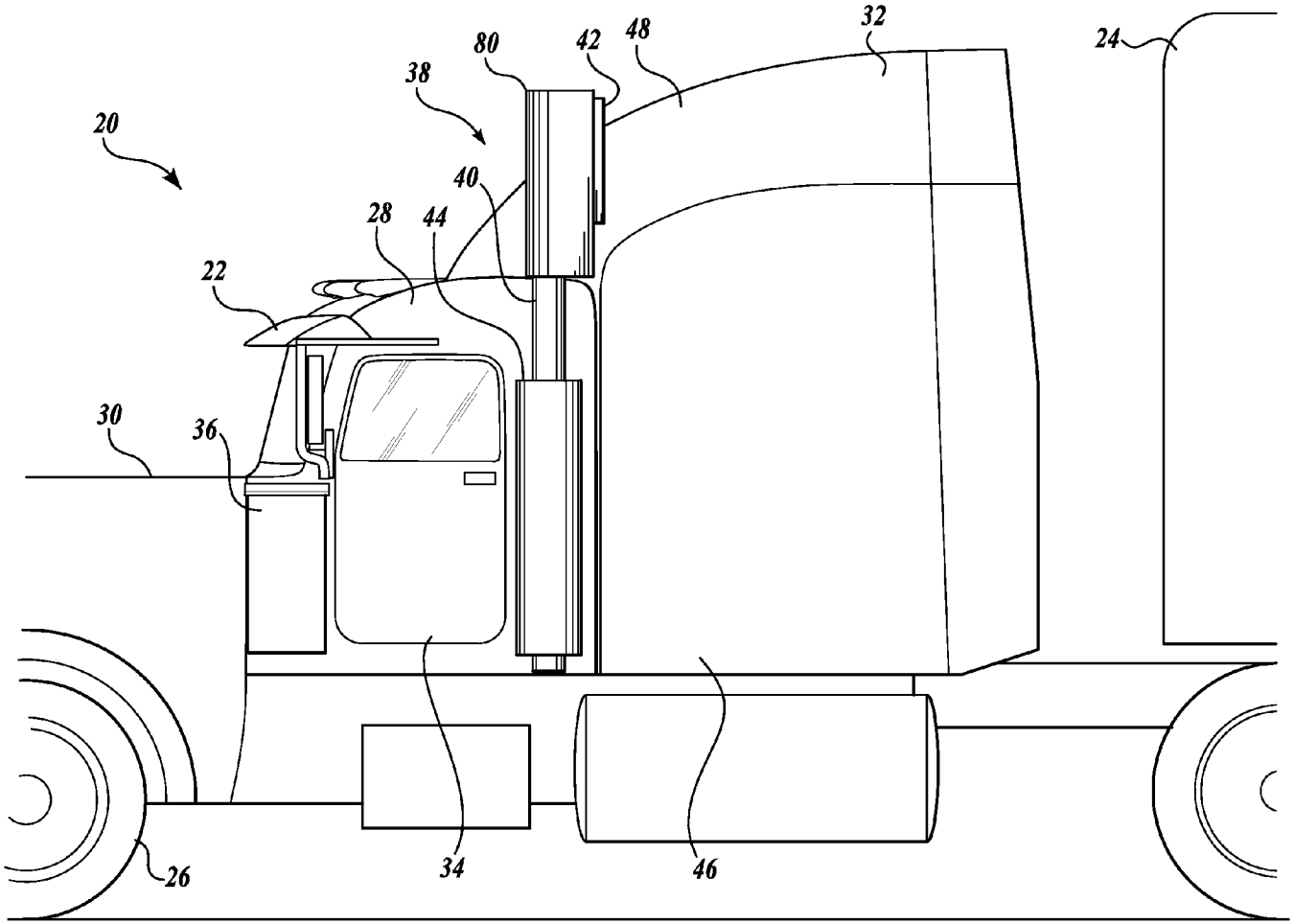
FIG. 4 shows a side view of a heavy-duty vehicle having a first exemplary embodiment of an exhaust stack fairing.

FIG. 4 shows a heavy-duty vehicle 22 having an exhaust stack 38 and fairing 80 combination according to a first embodiment of the presently disclosed subject matter. Similar to the exhaust stack shown in FIG. 1, the exhaust stack 38 includes a generally vertical exhaust pipe 40 located proximate to the cab 28 to discharge exhaust gases at a location above the cab. The exhaust stack 38 further includes a heat shield 44 surrounding a lower portion of the exhaust pipe 40.

Figure 5:
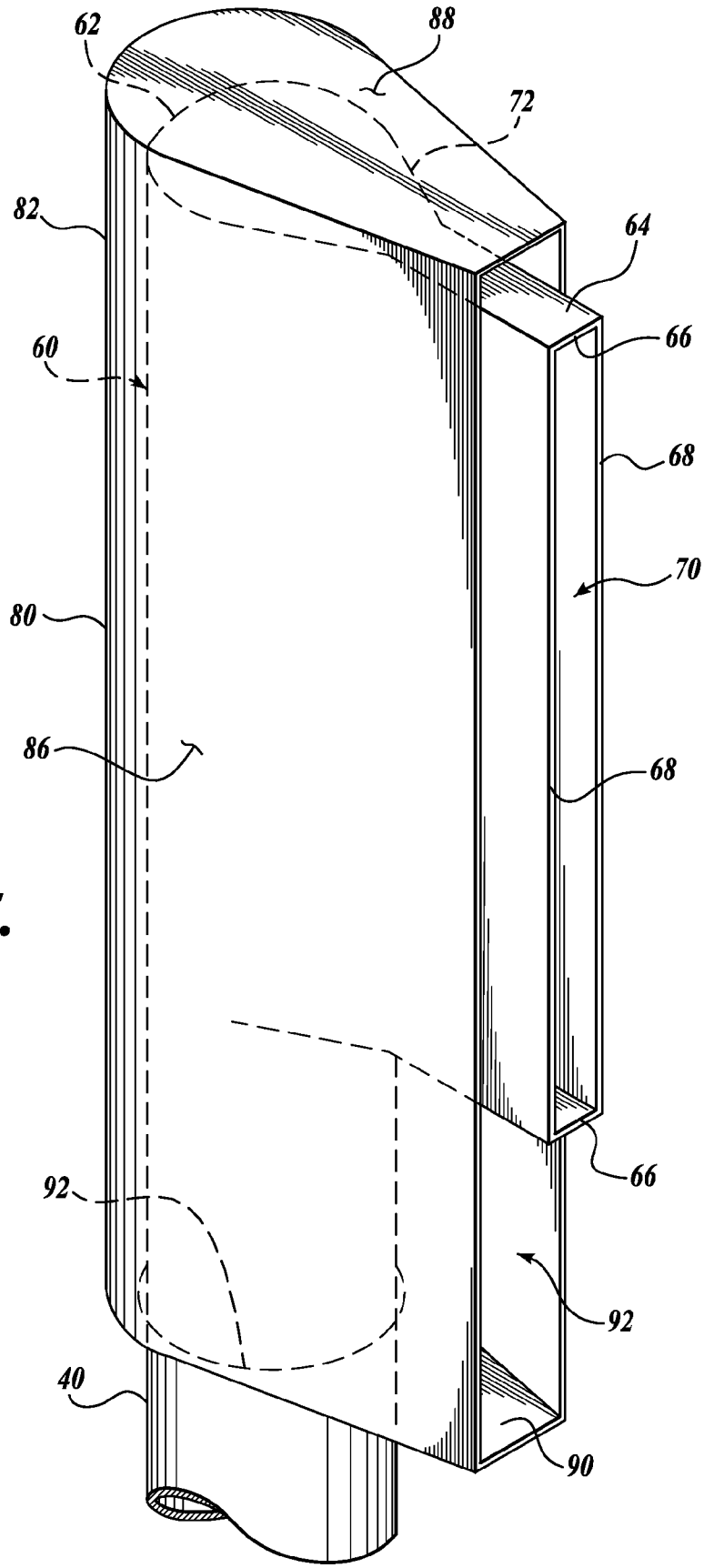
FIG. 5 shows an isometric view of the exhaust stack fairing shown in FIG. 4.
Figure 6:
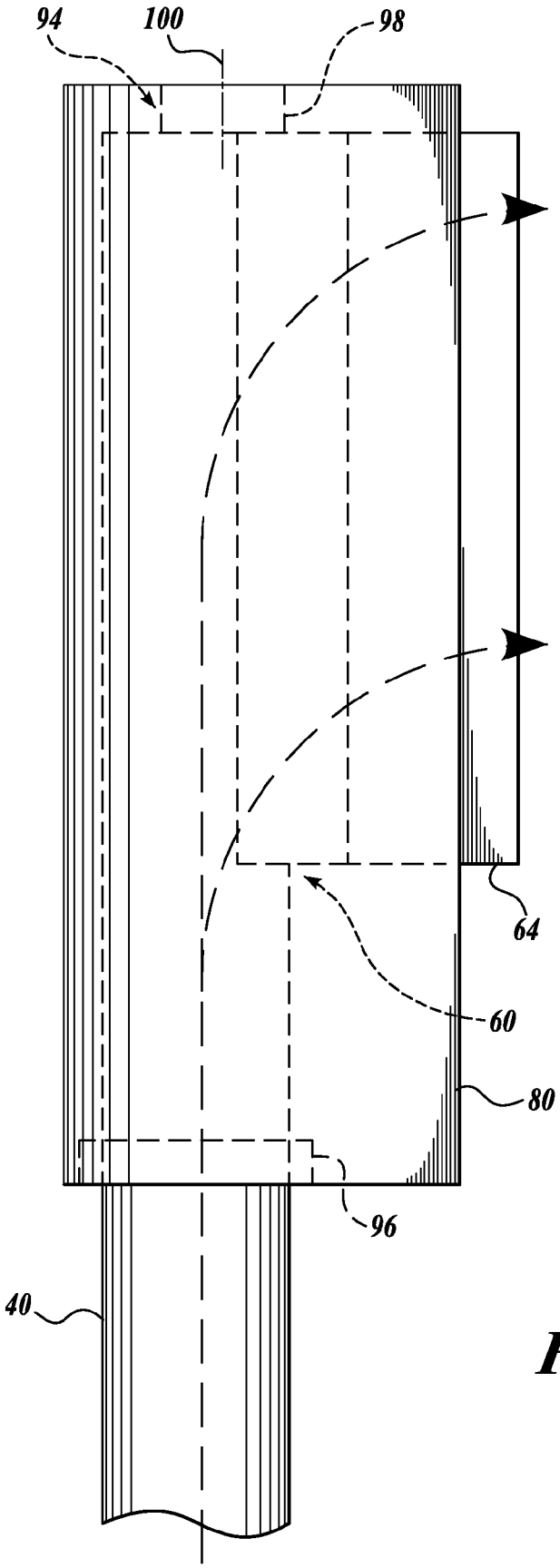
FIG. 6 shows a side view of the exhaust stack fairing shown in FIG. 4.
Figure 7:
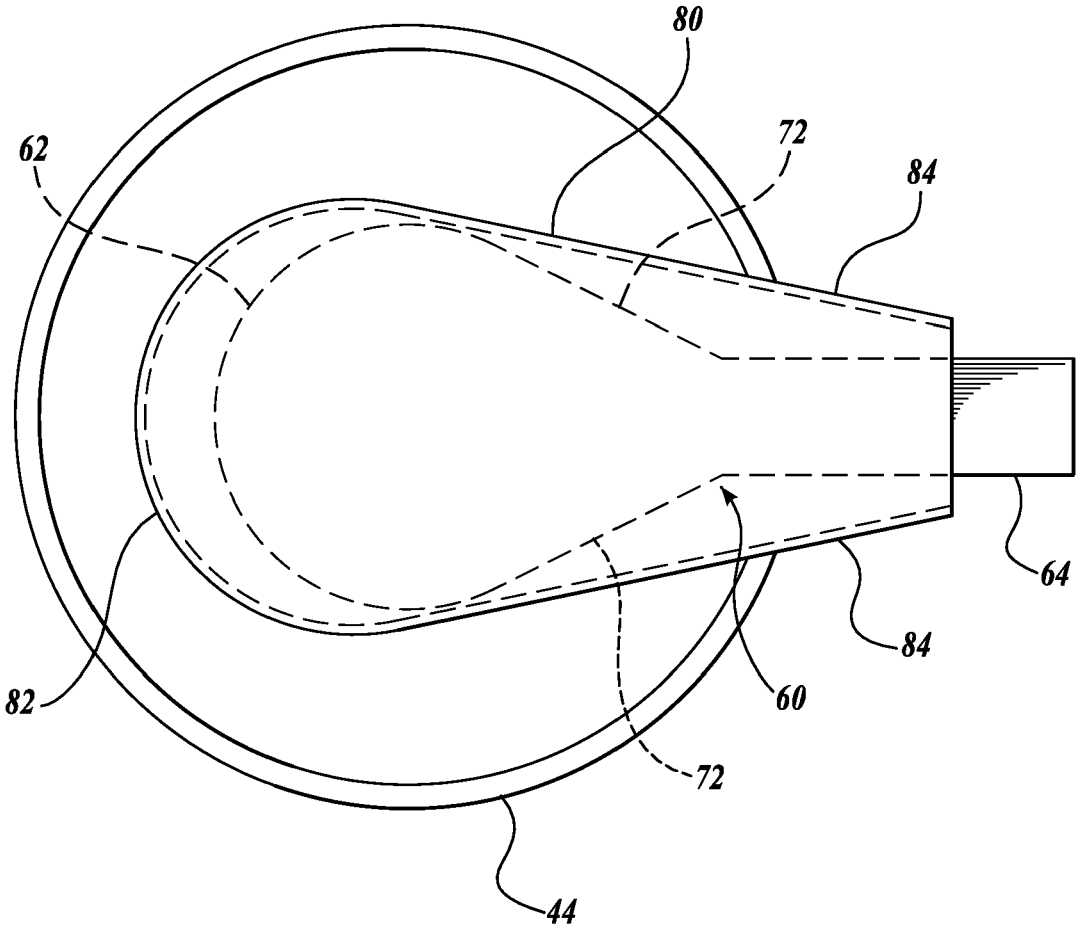
FIG. 7 shows a top view of the exhaust stack fairing shown in FIG. 4.

Referring now to FIGS. 5-7, the discharge end 60 of the exhaust pipe 40 includes a leading edge portion 62 and a trailing edge portion 64. In the illustrated embodiment, the leading edge portion 62 is formed to have a contour that substantially matches the contour of the leading edge of the exhaust pipe 40. More specifically, the leading edge portion 62 has a constant radius that is approximately equal to the radius of the exhaust pipe 40. It should be appreciated that the exhaust pipe 40 can vary in both size and shape. Accordingly, the leading edge portion 62 of the discharge end 60 can also vary according to the size and shape of the exhaust pipe 40. Further, because the leading edge portion 32 of the discharge end 60 is covered by the fairing 80, the shape of the leading edge can be formed to have a profile that differs from the leading edge of the exhaust pipe 40 without affecting the aerodynamic advantages provided by the fairing.

The trailing edge portion 64 extends from the leading edge portion 62 in a rearward direction. Cross sections of the trailing edge portion 64 taken in a vertical plane have a generally rectangular shape, with the shorter edges 66 positioned in the horizontal direction and the longer edges 68 positioned in the vertical direction. An elongate aperture 70 is formed on the rear side of the trailing edge portion 64 so that exhaust gases received from the engine are discharged in a rearward direction through the elongate aperture 70, as shown in FIG. 6. It should be appreciated that the illustrated embodiment is exemplary only, and other configurations are contemplated. For example, the trailing edge portion 64 need not have a rectangular cross section, but can instead have a cross section forming an ellipse, a rectangle with rounded corners, or any other suitable shape. Further, the aperture can be a single aperture or a plurality of apertures. In addition, the shape of the aperture is not limited to a rectangle, but can be any number of shapes, including an ellipse, a plurality of circles, and a plurality of vertical or horizontal slots. These and other alternate embodiments are contemplated and should be considered within the scope of the disclosed subject matter.

A tapered portion 72 connects the leading edge portion 62 and the trailing edge 64 portion of the discharge end. The sides of the tapered portion 72 are formed to be approximately tangent to the edges of the leading edge 62 to provide a smooth transition from the leading edge portion to the trailing edge portion 64.

The illustrated exhaust pipe 40 is shown to have an integrally formed discharge end 60. The discharge end 60 and the exhaust pipe 40 are formed from steel or any other suitable material, and individual parts of the pipe and discharge end are connected by welds, mechanical fasteners, or other suitable means. Other embodiments are contemplated wherein a separate discharge end is coupled to an existing exhaust pipe by welding, mechanical fastening, or any other suitable methods. Chrome or any other desired finish is optionally applied to all or portions of the exhaust pipe 40 and the discharge end 60.

It should be appreciated that various embodiments of the exhaust pipe 40 and discharge end 60 are possible. In this regard, the configuration of the leading edge portion 62, the trailing edge portion 64, and the tapered section 72 can be modified to simplify manufacturing or to improve the exhaust gas flow through the discharge end 60. Improved flow is particularly desirable as it can reduce back pressure created in the exhaust system, which can negatively impact engine performance.

Still referring to FIGS. 5-7, a fairing 80 is coupled to the exhaust stack 38 to improve the aerodynamic efficiency of the vehicle 22. The fairing 80 has a streamlined exterior surface 86. More specifically, the fairing surface 86 has a rounded leading edge 82 and sides 84 that taper inwardly toward the rear of the profile to form a substantially symmetrical airfoil.

The fairing 80 is shown to have a substantially constant cross section, but it should be appreciated that the shape of the fairing can vary according to the vehicle 22 with which the fairing is used, the structure to which the fairing is attached, the air flow in the area of the fairing, and other factors that would affect the aerodynamic performance of the fairing.

The fairing 80 is formed from a composite material, such as fiberglass, that has suitable strength and density. Alternately, the fairing can be formed from sheet metal, a polymeric material, or any other suitable material. It will be apparent to one of skill in the art that localized structure can be included, particularly on the interior of the fairing, to provide additional strength and stiffness.

An upper closeout 88 is positioned on the upper end of the fairing 80 to locally strengthen the fairing and to provide an aerodynamic top surface for the fairing. An optional lower closeout 90 is positioned on the lower end of the fairing. The lower closeout 90 is similar to the upper closeout 88, but includes an aperture 92 through which the exhaust pipe 40 extends. One or both of the upper and lower closeouts 88 and 90 are separately formed and then coupled to the fairing via adhesives, welding, mechanical fasteners, or any other suitable means. Alternately, one or both of the upper and lower closeouts can be integrally formed with the fairing.

The sides 84 of the fairing 80 and the upper and lower closeouts 88 and 90 cooperate to define a generally rectangular aperture 92 at the trailing edge of the fairing 80. In the illustrated embodiment, the aperture 92 is sized and configured so that the trailing edge portion 64 of the discharge end 60 of the exhaust pipe 40 extends at least partially therethrough when the fairing 80 his mounted to the exhaust stack 38. As a result, hot exhaust gases are discharged from the exhaust pipe 40 without directly impinging the fairing.

As shown in FIG. 6, the fairing 80 is mounted so that the exhaust pipe 40 extends upwardly into the inner cavity of the fairing, and the discharge end 60 of the exhaust pipe extends rearwardly through the aperture 92 located on the trailing edge of the fairing. A coupler 94 secures the fairing to the exhaust stack. In the illustrated embodiment, the coupler 94 includes first and second mounting fixtures 96 and 98.

The first mounting fixture 96 is positioned near the lower end of the fairing 80 and secures the lower end of the fairing in a fixed position relative to the exhaust pipe 38. The first mounting fixture 96 can be a band clamp that surrounds the exhaust pipe and is attached to the fairing. Alternately, the first mounting fixture can be an offset block secured to both the exhaust pipe and the fairing with conventional fasteners. It should be appreciated that various other mounting fixture configurations are possible, and such configurations should be considered within the scope of the present disclosure.

The second mounting fixture 98 is shown as a thermally insulated standoff disposed between the upper surface of the exhaust pipe discharge end 60 and the upper closeout 88. A fastener 100, such as a screw, a bolt, a rivet, or any other suitable fastener, secures the exhaust pipe 40, the standoff, and the fairing 80 to each other. It will be apparent to one of skill in the art that the described mounting fixtures are exemplary and alternate embodiments are possible.

The first and second mounting fixtures 96 and 98 are optionally formed from one or more materials that have low thermal conductivity. As a result, the mounting fixtures provide thermal insulation to prevent excessive heat from the exhaust pipe from being transferred to the fairing. Alternately, the mounting fixtures 96 and 98 can be coated with a thermal insulator. In still other embodiments, wherein the fairing 80 can withstand the temperature of the hot exhaust gases, such as when the fairing is formed from steel, no insulation is needed between the exhaust pipe and the fairing. In such cases, it is not necessary for the discharge end 60 of the exhaust pipe 40 to extend through the aperture 92 in the fairing 80. Further, in such cases, the exhaust gases can be discharged from the exhaust pipe 40 into the interior portion of the fairing 80. The exhaust gases then exit the fairing 80 through the fairing aperture 92.

Figure 8:
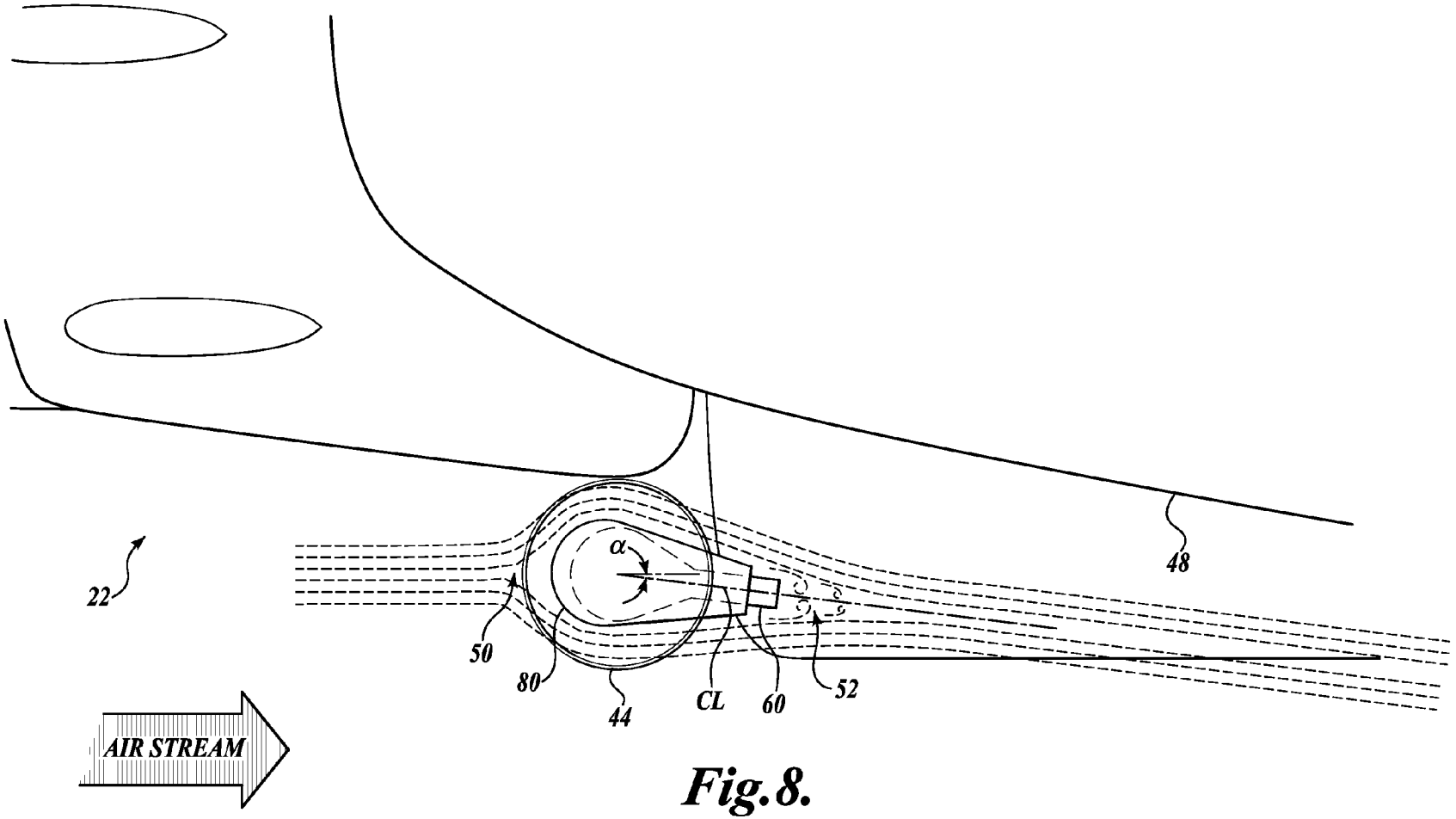
FIG. 8 shows a pattern of air flow around the exhaust pipe shown in FIG. 4 when the heavy-duty vehicle moves in a forward direction.

As shown in FIG. 8, the fairing 80 is mounted to the exhaust stack 38 so that the trailing edge of the symmetric airfoil extends in a generally rearward direction from the exhaust stack. The laminar air stream follows the streamlined contour of the fairing 80, separating from the fairing near the trailing edge. The resulting low pressure turbulent area 52 behind the fairing 80 is narrower than the turbulent area 52 behind the exhaust pipe 40 shown in FIG. 3. As a result, the pressure difference between the leading edge and the trailing edge, and thus, the pressure drag on the exhaust stack 38, is reduced.

In addition to reducing the pressure drag on the exhaust stack 38, the fairing 80 can also be positioned to redirect air that would otherwise impinge the cab 28, thereby further reducing vehicle drag. Still referring to FIG. 8, the fairing 80 is mounted so that centerline CL of the fairing forms an angle $\alpha$ with the direction of the air stream when the vehicle 22 moves in a forward direction. When the laminar air flow separates from the fairing 80, it generally flows in a direction parallel to the centerline CL of the fairing. In the illustrated embodiment, the angle $\alpha$ is approximately 7°, which is suitable to direct the air flow around the outboard edges of the cab 28, thereby reducing overall drag. It should be appreciated that the optimal value of angle $\alpha$ for reducing drag will vary depending upon the configuration of the particular vehicle to which the fairing is mounted. For some vehicles, the optimal value for angle $\alpha$ may be in the range of 0°-15°. It will be appreciated that as the value of angle $\alpha$ is increased, the drag reduction resulting from redirecting the air flow away from the cab is offset by an increase in drag on the fairing itself.

Figure 9:
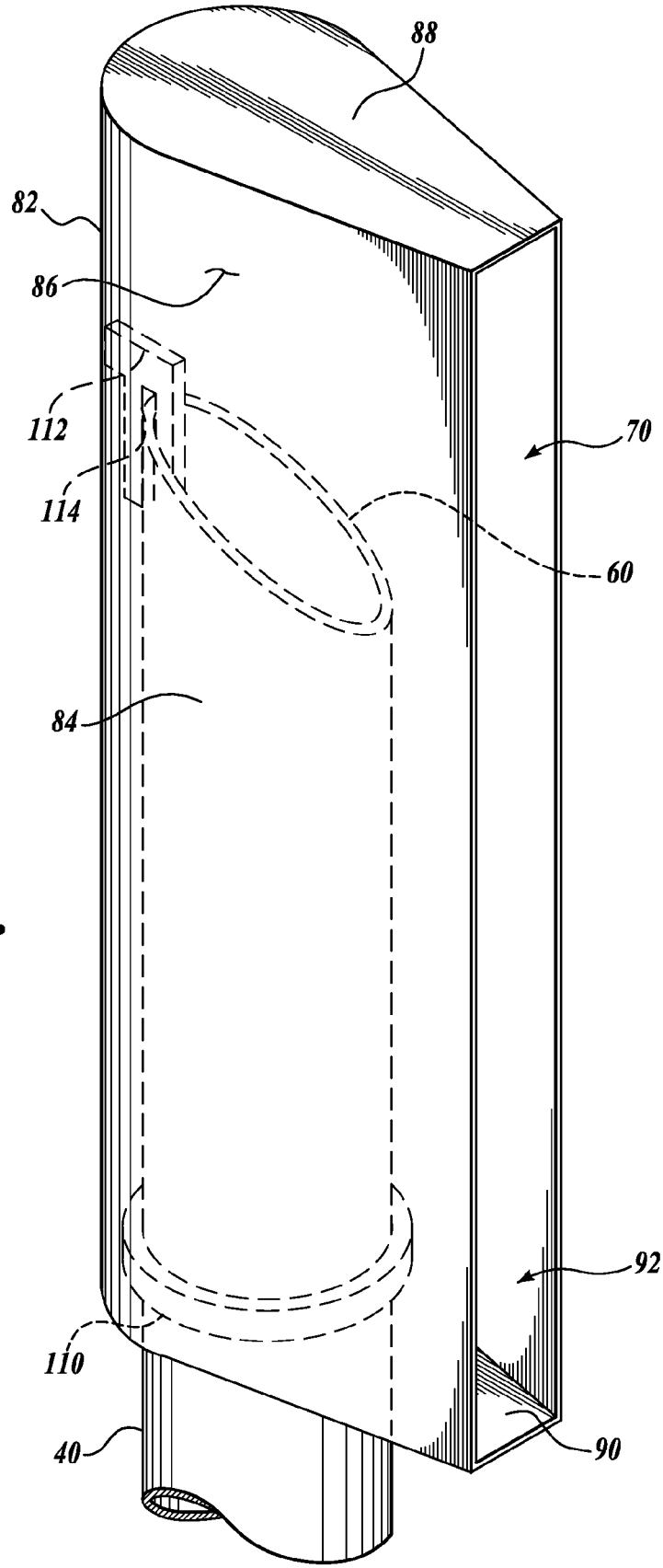
FIG. 9 shows an isometric view of a second exemplary embodiment of an exhaust stack fairing.
Figure 10:
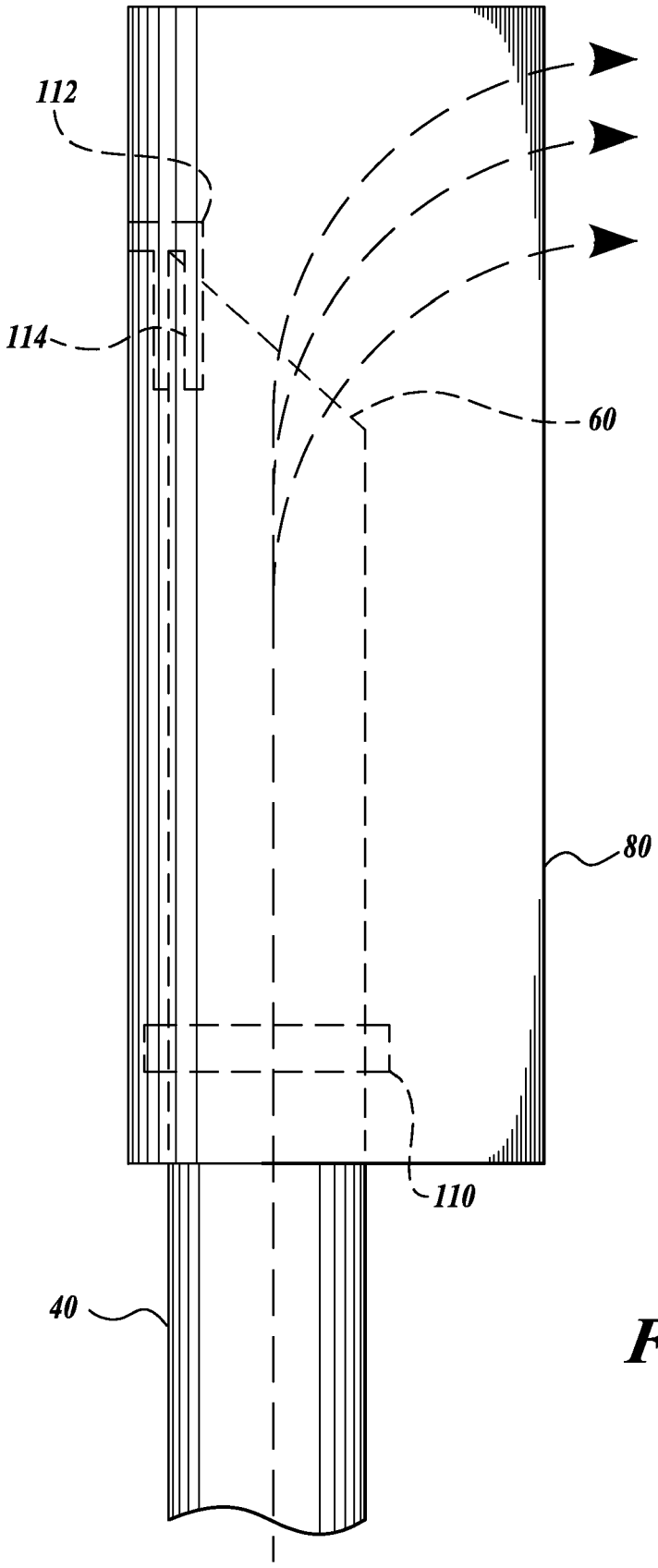
FIG. 10 shows a side view of the exhaust stack fairing shown in FIG. 9.

Referring now to FIGS. 9 and 10, an alternate embodiment of an exhaust stack fairing 80 will be described. The illustrated embodiment is suitable for mounting to a known exhaust pipe, i.e., the fairing can be retrofitted to an exhaust stack to improve the aerodynamic efficiency of the exhaust stack. The exhaust stack 38 shown includes an exhaust pipe 40 that extends upward in a vertical direction. The exhaust pipe terminates at a discharge end 60 having a rearward facing bevel, which is a common configuration for heavy-duty vehicles.

The fairing 80 shown in FIGS. 9 and 10 is similar to the fairing 80 shown in FIGS. 4-7, wherein like reference numbers refer to similar structure. The main difference between the two embodiments is the structure that couples the fairing 80 to the exhaust pipe 38. The first mounting fixture 110 is similar to the first mounting fixture 96 shown in FIG. 6. In this regard, the first mounting fixture 110 is positioned near the lower end of the fairing 80 and secures the lower end of the fairing to the exhaust pipe 40. In one embodiment, a band clamp secures a portion of exhaust pipe 40 in a fixed position relative to the fairing 80.

The second mounting fixture 112 is a standoff secured to an interior portion of the fairing 80. A slot 114 is formed in the second mounting fixture 114 and is sized and configured to receive a portion of the exhaust pipe wall when the discharge end 60 of the exhaust pipe 40 is inserted into the fairing. More specifically, the wall of the exhaust pipe 40 is received within the slot 114 to restrain the exhaust pipe against movement in a horizontal direction. The first and second mounting fixtures 110 and 112 cooperate to secure the fairing 80 to the exhaust pipe 40. It will be appreciated the described mounting features are exemplary only and should not be considered limiting. Various alternative systems and fixtures are contemplated to secure the fairing to the exhaust pipe, and embodiments that utilize such features should be considered within the scope of the present disclosure.

As shown in FIG. 9, exhaust gases discharged from the exhaust pipe 40 enter the interior cavity of the fairing 80 and flow rearwardly through the aperture 92 at the trailing edge of the fairing. Because the interior of the fairing is directly exposed to high temperature exhaust, the fairing is formed from materials having suitable strength and durability when subjected to the elevated exhaust temperatures. In one suitable embodiment, the fairing is formed from steel or another suitable metal. Alternately, the interior cavity of the fairing may be lined with an insulating material to protect the outer shell of the fairing against the elevated exhaust temperatures.

It should be appreciated that the illustrated embodiments are exemplary, and various alternatives to the described features are possible. Accordingly, it is contemplated that various changes can be made therein without departing from the spirit and scope of the invention.

The embodiments of the invention in which an exclusive property or privilege is claimed are defined as follows:

1. A fairing for an exhaust stack of a heavy-duty vehicle, the exhaust stack including an exhaust pipe having an intake end for receiving exhaust gases from an internal combustion engine and a discharge end comprising an orifice through which the exhaust gases are discharged from the exhaust pipe, the fairing comprising:

(a) a streamlined exterior surface;

(b) a cavity for receiving a portion of the discharge end of the exhaust pipe;

(c) an aperture disposed on a rear portion of the exterior surface, wherein the discharge end of the exhaust pipe extends through the aperture so that the orifice is positioned outside of the cavity; and (d) a coupler for coupling the fairing to the discharge end of the exhaust pipe, wherein exhaust gases received by the exhaust pipe are discharged from the exhaust pipe rearward of the fairing.

2. The fairing of claim 1, wherein the exterior surface comprises a rounded leading edge.

3. The fairing of claim 2, wherein the exterior surface comprises a tapered trailing edge.

4. The fairing of claim 1, wherein the aperture forms a substantially vertical elongate slot.

5. The fairing of claim 1, wherein the coupler comprises a first mounting fixture secured within the cavity of the fairing, the first mounting structure being coupleable to the discharge end of the exhaust pipe.

6. The fairing of claim 5, wherein the coupler further comprises a second mounting fixture secured within the cavity of the fairing, the second mounting fixture having a slot sized and configured to receive a portion of the exhaust pipe.

7. An aerodynamic exhaust stack for a heavy-duty vehicle having an internal combustion engine, the exhaust stack comprising:

(a) an exhaust pipe having an intake end in fluid connection with the engine to receive exhaust gases and a discharge end comprising a first aperture for discharging the exhaust gases from the exhaust pipe to an area outside of the vehicle, at least a portion of the exhaust pipe extending in a substantially vertical direction and being exposed to an air stream when the vehicle moves in a forward direction; and (b) a fairing coupled to the exhaust pipe, the fairing comprising:

(i) a streamlined exterior surface;

(ii) a cavity for receiving a portion of the discharge end of the exhaust pipe;

(iii) a second aperture extending through a rear portion of the exterior surface, wherein the discharge end of the exhaust pipe extends through the second aperture so that the first aperture is disposed outside of the fairing; and (iv) a coupler for coupling the fairing to the discharge end of the exhaust pipe, wherein exhaust gases are discharged from the discharge end of the exhaust pipe at an area outside of the fairing.

8. The exhaust stack of claim 7, wherein the exterior surface comprises a rounded leading edge.

9. The exhaust stack of claim 7, wherein the exterior surface comprises a tapered trailing edge.

10. The exhaust stack of claim 9, wherein the second aperture defines a substantially vertical elongate slot.

11. The exhaust stack of claim 9, wherein the fairing comprises a centerline, the centerline defining an angle with an air stream when the vehicle moves in a forward direction, the angle having a value between approximately 0° and 15°.

12. The fairing of claim 11, wherein the angle has a value of approximately 7°.

13. The exhaust stack of claim 7, the exhaust pipe having a substantially cylindrical portion, the discharge end comprising:

(a) a trailing edge portion in fluid communication with the cylindrical portion;

(b) a tapered portion disposed between the trailing edge portion and the cylindrical portion, wherein the first aperture is disposed on the trailing edge portion.

14. The exhaust stack of claim 13, wherein the trailing edge portion extends through the second aperture.

15. The exhaust stack of claim 13, wherein the trailing edge portion has a substantially rectangular cross section.

16. The exhaust stack of claim 13, wherein the first aperture comprises an elongate slot.

* * * * *